US007967876B2

(12) United States Patent
Aradi et al.

(10) Patent No.: US 7,967,876 B2
(45) Date of Patent: Jun. 28, 2011

(54) NANOALLOY FUEL ADDITIVES

(75) Inventors: Allen A. Aradi, Glen Allen, VA (US); Carl K. Esche, Jr., Richmond, VA (US); Katrina McIntosh, Midlothian, VA (US); Tze-Chi Jao, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 209 days.

(21) Appl. No.: 11/465,160

(22) Filed: Aug. 17, 2006

(65) Prior Publication Data

US 2008/0040969 A1 Feb. 21, 2008

(51) Int. Cl.
*C10L 1/12* (2006.01)
*C10L 1/30* (2006.01)

(52) U.S. Cl. ..... 44/363; 44/354; 44/357; 44/358; 44/603

(58) Field of Classification Search ..... 44/354, 44/603, 363, 358, 355; 420/523; 252/70
See application file for complete search history.

(56) References Cited

U.S. PATENT DOCUMENTS

| | | | | |
|---|---|---|---|---|
| 3,019,145 | A | 1/1962 | Whitby | |
| 5,667,751 | A | 9/1997 | Taylor, Jr. | |
| 5,728,913 | A | 3/1998 | Finkl | |
| 5,738,692 | A | 4/1998 | Wright | |
| 6,136,048 | A * | 10/2000 | Birchem et al. | 44/354 |
| 6,432,320 | B1 * | 8/2002 | Bonsignore et al. | 252/70 |
| 6,432,556 | B1 | 8/2002 | Brauer et al. | |
| 2003/0213166 | A1 | 11/2003 | Stewart | |
| 2005/0066571 | A1 | 3/2005 | Wakefield | |
| 2005/0106061 | A1 | 5/2005 | Oeste | |
| 2006/0110279 | A1 * | 5/2006 | Han et al. | 420/523 |
| 2007/0180760 | A1 | 8/2007 | Zhou et al. | |

FOREIGN PATENT DOCUMENTS

| | | |
|---|---|---|
| GB | 711895 | 7/1954 |
| GB | 792704 | 4/1958 |
| GB | 1079698 | 8/1967 |
| WO | WO 9744414 | * 11/1997 |
| WO | WO 0200812 | * 1/2002 |
| WO | WO 2004/065529 | 8/2004 |

OTHER PUBLICATIONS

European Search Report, European Application No. 07 110 827, European Patent Office, Jul. 2, 2009, 4 pages.

(Continued)

*Primary Examiner* — Ellen M McAvoy
*Assistant Examiner* — Chantel Graham

(57) ABSTRACT

There is disclosed a composition comprising an alloy represented by the following generic formula $(A_a)_n(B_b)_n(C_c)_n(D_d)_n(\ldots)_n$; wherein each capital letter and ( . . . ) is a metal; wherein A is a combustion modifier; B is a deposit modifier; C is a corrosion inhibitor; and D is a combustion co-modifier/electrostatic precipitator enhancer; wherein each subscript letter represents compositional stoichiometry; wherein n is greater than or equal to zero; and wherein the alloy comprises at least two different metals; and with the proviso that if the metal is cerium, then its compositional stoichiometry is less than about 0.7. There is also disclosed a fuel additive comprising an alloy; a fuel composition comprising the fuel additive composition; methods of making the fuel additive composition; and methods of using the disclosed alloy.

23 Claims, 9 Drawing Sheets

Characterization of $Cu_{0.75}Mg_{0.25}$ Nanoalloy 1

OTHER PUBLICATIONS

F. Jurany, J. B. Suck, S. Janssen, "Vibrational and magnetic properties of supersaturated Cu100-xFex," Applied Physics A: Materials Science & Processing, vol. 74, 2002, pp. 5972-5794, XP002532147.

F. Fukamichi, K. Aoki, T. Masumoto, T. Goto, C. Murayama, N. Mori, "Large spontaneous volume magnetrostriction and pressure effects on the magnetic properties of amorphous Ce-Fe alloys," Journal of Alloys and Compounds, 256, 1997, pp. 18-26, XP002532148.

F. Miani, H. J. Fecht, "Evaluating the mechanochemical power transfer in the mechanosysthesis of nanophase Fe-C and Fe-Cu powders," International Journal of Refractory Metals & Hard Metals, vol. 17, 1999, pp. 133-139, XP002532149.

* cited by examiner

NANOALLOY FUEL ADDITIVES

FIELD OF THE DISCLOSURE

The present disclosure relates to new types of fuel additive compositions where each composition can comprise an alloy of two or more different metals.

BACKGROUND OF THE DISCLOSURE

Metal-containing fuel additives are known in many forms, from homogeneous solutions in aqueous or hydrocarbon carrier media, or heterogeneous particle clusters extending all the way to visible particles formulated in the slurry form. In between is the nanoparticle range commonly defined to be metal particles above cluster size but below 100 nanometer size range. In all known instances where these metal-containing additives are used, they are introduced to the fuel/combustion/flue gas systems as single, metal-containing additive formulations or as mixtures of different metals.

Metal-containing fuel additives of the nature described above are usually formulated as water soluble or oil soluble concentrates, either as homogeneously dissolved metals or metal nanoparticles. In a lot of instances, the concentrates are micelle dispersions in a carrier fluid, or particle suspensions containing the desired metal atoms. In cases where more than one metal is deemed necessary, then simple mixtures of the desired metals are included either in the same formulation, or added to the fuel separately.

The current use of metals in combustion systems relies on chemistries fostered by each metal type as dictated by its unique orbital and electronic configuration described apart. This means that in additives formulated with metal mixtures, at the time of the intended activity the metals act independently from one another during fuel combustion. In fact the physics of a combusting charge is such that there is no likelihood that a mixed metal additive will land the different metal atoms within the same location on the combusting fuel species so that they may act in unison as one compound.

The physical form of metal-containing additives of most recent interest is the nanoparticle form because of its unique surface to volume ratios and active site numbers and shapes. As is to be expected, there is interest in mixed metal nanoadditves because each metal tends to have specific functions.

Combustion systems burning hydrocarbonaceous fuels experience various degrees of combustion inefficiencies due to fuel properties, system design, air/fuel ratios, residence time of fuel/air charge in the combustion zone, and fuel/air mixing rates. These factors lead to imperfect combustion giving rise to at least one of 1) a lowering of targeted efficiencies, 2) elevated emission of environmental pollutants, 3) lowered operating durability due to deposits in the combustion system, and 4) corrosion of system hardware due to the presence of undesirable fuel borne corrosion precursors that are converted to corrosives during certain combustion conditions. Fuel-side solutions to these problems usually involved some sort of "clean fuel" selection based upon tested criteria, or simply the use of additives.

What is needed is an additive composition that can be formulated to enhance a specific function and improve at least one of the problems addressed above.

SUMMARY OF THE DISCLOSURE

In accordance with the disclosure, there is disclosed a composition comprising an alloy represented by the following generic formula $(A_a)_n(B_b)_n(C_c)_n(D_d)_n(\ldots)_n$; wherein each capital letter and ( . . . ) is a metal; wherein A is a combustion modifier; B is a deposit modifier; C is a corrosion inhibitor; and D is a combustion co-modifier/electrostatic precipitator enhancer; wherein each subscript letter represents compositional stoichiometry; wherein n is greater than or equal to zero; and wherein the alloy comprises at least two different metals; and with the proviso that if the metal is cerium, then its compositional stoichiometry is less than about 0.7.

In an aspect, there is also disclosed a fuel additive composition comprising a treated alloy represented by the following generic formula $(A_a)_n(B_b)_n(C_c)_n(D_d)_n(\ldots)_n$; wherein each capital letter and ( . . . ) is a metal; wherein A is a combustion modifier; B is a deposit modifier; C is a corrosion inhibitor; and D is a combustion co-modifier/electrostatic precipitator enhancer; wherein each subscript letter represents compositional stoichiometry; wherein n is greater than or equal to zero; and wherein the alloy comprises at least two different metals; and with the proviso that if the metal is cerium, then its compositional stoichiometry is less than about 0.7.

Moreover, there is disclosed a method of producing a fuel additive composition comprising treating an alloy with an organic compound; and solubilizing the treated alloy in a diluent; wherein the alloy is represented by the following generic formula $(A_a)_n(B_b)_n(C_c)_n(D_d)_n(\ldots)_n$; wherein each capital letter and ( . . . ) is a metal; wherein A is a combustion modifier; B is a deposit modifier; C is a corrosion inhibitor; and D is a combustion co-modifier/electrostatic precipitator enhancer; wherein each subscript letter represents compositional stoichiometry; wherein n is greater than or equal to zero; and wherein the alloy comprises at least two different metals; and with the proviso that if the metal is cerium, then its compositional stoichiometry is less than about 0.7.

Additionally, there is disclosed a combustion modifier comprising an alloy represented by the following generic formula $(A_a)_n(B_b)_n(C_c)_n(D_d)_n(\ldots)_n$; wherein each capital letter and ( . . . ) is a metal; wherein A is a combustion modifier; B is a deposit modifier; C is a corrosion inhibitor; and D is a combustion co-modifier/electrostatic precipitator enhancer; wherein each subscript letter represents compositional stoichiometry; wherein n is greater than or equal to zero; and wherein the alloy comprises at least two different metals, one of which is A; and with the proviso that if the metal is cerium, then its compositional stoichiometry is less than about 0.7.

There is also disclosed a deposit modifier comprising an alloy represented by the following generic formula $(A_a)_n(B_b)_n(C_c)_n(D_d)_n(\ldots)_n$; wherein each capital letter and ( . . . ) is a metal; wherein A is a combustion modifier; B is a deposit modifier; C is a corrosion inhibitor; and D is a combustion co-modifier/electrostatic precipitator enhancer; wherein each subscript letter represents compositional stoichiometry; wherein n is greater than or equal to zero; and wherein the alloy comprises at least two different metals, one of which is B; and with the proviso that if the metal is cerium, then its compositional stoichiometry is less than about 0.7.

Moreover, in another aspect, there is disclosed a corrosion modifier comprising an alloy represented by the following generic formula $(A_a)_n(B_b)_n(C_c)_n(D_d)_n(\ldots)_n$; wherein each capital letter and ( . . . ) is a metal; wherein A is a combustion modifier; B is a deposit modifier; C is a corrosion inhibitor; and D is a combustion co-modifier/electrostatic precipitator enhancer; wherein each subscript letter represents compositional stoichiometry; wherein n is greater than or equal to zero; and wherein the alloy comprises at least two different metals, one of which is C; and with the proviso that if the metal is cerium, then its compositional stoichiometry is less than about 0.7.

In an aspect, there is disclosed an emissions modifier comprising an alloy represented by the following generic formula $(A_a)_n(B_b)_n(C_c)_n(D_d)_n(\ldots)_n$; wherein each capital letter and (. . . ) is a metal; wherein A is a combustion modifier; B is a deposit modifier; C is a corrosion inhibitor; and D is a combustion co-modifier/electrostatic precipitator enhancer; wherein each subscript letter represents compositional stoichiometry; wherein n is greater than or equal to zero; and wherein the alloy comprises at least two different metals, one of which is selected from the group consisting of A, B and D; and with the proviso that if the metal is cerium, then its compositional stoichiometry is less than about 0.7.

Moreover, there is disclosed a use in a combustion system of a nanoalloy fuel additive, wherein the combustion system is selected from the group consisting of any diesel-electric hybrid vehicle, a gasoline-electric hybrid vehicle, a two-stroke engine, stationary burners, waste incinerators, diesel fuel burners, diesel fuel engines, jet engines, HCCI engines automotive diesel engines, gasoline fuel burners, gasoline fuel engines, and power plant generators.

Further, there is disclosed a use in an emission control system of a nanoalloy fuel additive, wherein the emission control system is selected from the group consisting of an oxidation catalyst, particulate trap, catalyzed PT, $NO_x$ trap, on-board $NO_x$ additive dosing into the exhaust to remove $NO_x$, and plasma reactors to remove $NO_x$.

Additional objects and advantages of the disclosure will be set forth in part in the description which follows, and can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate one (several) embodiment(s) of the disclosure and together with the description, serve to explain the principles of the disclosure.

DESCRIPTION OF THE EMBODIMENTS

Figure 1:
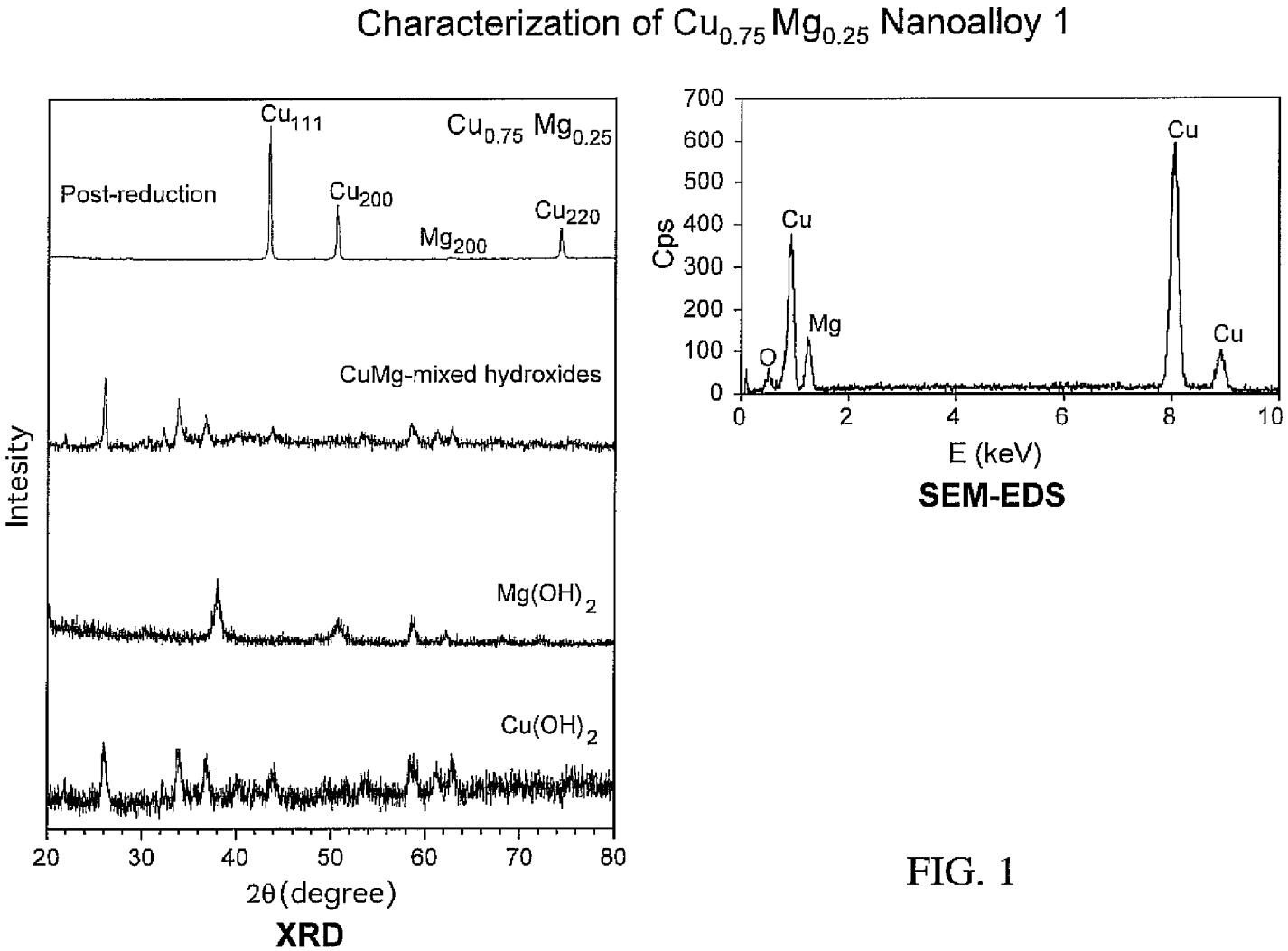
FIGS. 1-5 illustrate the analytical results of various nanoalloys of the present disclosure.

Reference will now be made in detail to the present embodiment(s) (exemplary embodiments) of the disclosure, an example(s) of which is (are) illustrated in the accompanying drawings.

The present disclosure relates in one embodiment to a fuel additive composition comprising an alloy of two or more metals. The fuel additive composition can be provided to a fuel composition. As described herein, the alloy is different chemically from any of its constituent metals because it shows a different spectrum in the XRD than that of the individual constituent metals. In other words, it is not a mixture of different metals, but rather, an alloy of the constituent metals used.

The primary determining factors for activities metals in fuel combustion to effect system efficiency, emissions, deposit/slag/fouling, and corrosion is primarily the type, shape, size, electronic configuration, and energy levels of lowest unoccupied molecular orbitals (LUMO) and highest occupied molecular orbitals (HOMO) made available by the metal to interact with those of the intended substrate species at the conditions when these species are to be chemically and physically transformed. These LUMO/HOMO electronic configurations are unique to every metal, hence the innate physics/chemistry uniqueness observed between, for example, Mn and Pt, or Mn and Al, etc.

The disclosed alloy is the result of combining the different constituent metal atoms in the compound. This means that the LUMO/HOMO orbitals of the alloy are hybrids of those characteristic of the respective different metal atoms. Therefore, an alloy, for use in a fuel additive composition, ensures that all constituent metals in the alloy particle end up at the same site of the combusting fuel species and act as one, but in the modified i.e., alloy form. The advantages of an alloy for this purpose would be due to unique modifications imparted to the LUMO/HOMO electronic and orbital configurations of the particles by the mixing of LUMO/HOMO orbitals of the different respective alloy composite metals. The number and shape of active sites would be expected to also change significantly in the alloy composites relative to the number and shape of active sites in equivalent but non-alloy mixtures. This unique orbital and electronic mixing at the LUMO/HOMO orbital level in the alloys is not possible by simply mixing particles of the respective metals in appropriate functional ratios. This disclosure is directed to alloys present in compositions for multifunctional applications in, for example, beneficial combustion, emissions, and deposits modifications.

Disclosed herein is a composition comprising an alloy represented by the following generic formula $(A_a)_n(B_b)_n(C_c)_n(D_d)_n(\ldots)_n$; wherein each capital letter and (. . . ) is a metal; wherein A is a combustion modifier; B is a deposit modifier; C is a corrosion inhibitor; and D is a combustion co-modifier/electrostatic precipitator (ESP) enhancer; wherein each subscript letter represents compositional stoichiometry; wherein n is greater than or equal to zero; and wherein the alloy comprises at least two different metals; and with the proviso that if the metal is cerium, then its compositional stoichiometry is less than about 0.7. In an aspect, the (. . . ) is understood to include the presence of at least one metal other than those defined by A, B, C and D and the respective compositional stoichiometry.

Each capital letter in the above-disclosed formula can be a metal. The metal can be selected from the group consisting of metalloids, transition metals, and metal ions. In an aspect, each capital letter can be the same or different. As an example, both B and C can be magnesium (Mg).

Sources of the metal can include, but are not limited to, their aqueous salts, carbonyls, oxides, organometallics, and zerovalent metal powders. The aqueous salts can comprise, for example, hydroxides, nitrates, acetates, halides, phosphates, phosphonates, phosphites, carboxylates, and carbonates.

As disclosed above, A can be a combustion modifier. In an aspect, A is a metal selected from the group consisting of Mn, Fe, Co, Cu, Ca, Rh, Pd, Pt, Ru, Ir, Ag, Au, and Ce.

As disclosed above, B can be a deposit modifier. In an aspect, B is a metal selected from the group consisting of Mg, Al, Si, Sc, Ti, Zn, Sr, Y, Zr, Mo, In, Sn, Ba, La, Hf, Ta, W, Re, Yb, Lu, Cu and Ce.

As disclosed above, C can be a corrosion inhibitor. In an aspect, C is a metal selected from the group consisting of Mg, Ca, Sr, Ba, Mn, Cu, Zn, and Cr.

As disclosed above, D can be a combustion co-modifier/electrostatic precipitator (ESP) enhancer. In an aspect, D is a metal selected from the group consisting of Li, Na, K, Rb, Cs, and Mn.

In a further aspect, A, B, and/or D can be an emissions modifier, wherein the metals for each group are disclosed above.

The subscript letters of the disclosed formula represent compositional stoichiometries. For example, for an $A_aB_b$ alloy, such as $Fe_{0.80}Ce_{0.20}$ disclosed herein, a=0.80 and b=0.20. In an aspect, if the metal in the disclosed alloy is cerium (Ce) then its compositional stoichiometry is less than about 0.7, for example less than about 0.5, and as a further example less than about 0.3.

In an aspect, the disclosed alloy can be a nanoalloy. The nanoalloy can have an average particle size of from about 1 to about 100 nanometers, for example, from about 5 to about 75 nanometers, and as a further example from about 10 to about 35 nanometers.

The alloy can be monofunctional such that it can perform any one of the following functions, for example: combustion modifier (Group A metal), deposit modifier (Group B metal), corrosion inhibitor (Group C metal), or combustion co-modifier/electrostatic precipitator enhancement (ESP) (Group D metal).

The alloy can also be bifunctional such that it can perform any two of the functions identified above. In an aspect, the alloy can be trifunctional (i.e., it can perform any three of the functions identified above); tetrafunctional (i.e., it can perform any four of the functions identified above); or polyfunctional (i.e., it can perform any number of the functions identified above as well as those that are undefined).

In an aspect, the disclosed alloy can comprise a metal that can be polyfunctional i.e., it is able to perform at least two functions, such as those identified above. For example, as disclosed below, magnesium can function as a deposit modifier (Group B metal) and as a corrosion inhibitor (Group C metal). As a further example, an alloy comprising $Cu_{10}Mg_{90}$ would be a bimetallic alloy that is polyfunctional because the copper can function as a combustion modifier, a deposit modifier, and as a corrosion inhibitor and the magnesium can function as both a deposit modifier and a corrosion inhibitor.

In an aspect, the alloy can be a nanoalloy and can be bimetallic (i.e., any combination of two different metals from the same or different functional groups, e.g., $A_aB_b$, or $A_aA'_{a'}$); trimetallic (i.e., any combination of three different metals from the same or different functional groups, e.g., $A_aB_bC_c$, or $A_aA'_{a'}A''_{a''}$ or $A_aA'_{a'}B_b$); tetrametallic (i.e., any combination of four different metals from the same or different functional groups, e.g., $A_aB_bC_cD_d$ or $A_aA'_{a'}A''_{a''}A'''_{a'''}$ or $A_aB_bB'_bC_c$); or polymetallic (i.e., any combination of two or more metals from the same or different functional groups, e.g., $A_aB_bC_cD_dE_e$ . . . etc. or $A_aB_bB'_bC_cD_dD'_dE_e$). The alloy must comprise at least two different metals, but beyond two the number of metals in each alloy would be dictated by the requirements of each specific combustion system and/or exhaust after treatment system.

In an aspect, the composition can comprise an alloy selected from the group consisting of a bimetallic, trimetallic, tetrametallic and polymetallic, and wherein the alloy is selected from the group consisting of monofunctional, bifunctional, trifunctional, tetrafunctional, and polyfunctional.

Monofunctional nanoalloy combustion modifier compositions can be prepared from any combination of metals in group A as shown in the following non-limiting examples:

Bimetallics ($A_aA'_{a'}$): Mn/Fe, Mn/Co, Mn/Cu, Mn/Ca, Mn/Rh, Mn/Pd, Mn/Pt, Mn/Ru, Mn/Ce, Fe/Co, Fe/Cu, Fe/Ca, Fe/Rh, Fe/Pd, Fe/Rh, Fe/Pd/, Fe/Pt, Fe/Ru, Fe/Ce, Cu/Co, Cu/Ca, Cu/Rh, Cu/Pd, Cu/Pt, Cu/Ce, etc;

Trimetallics ($A_aA'_{a'}A''_a$): Mn/Fe/Co, Mn/Fe/Cu, Mn/Fe/Ca, etc; and

Polymetallics ($A_aA'_{a'}A''_{a''}A'''_{a'''}$ . . . etc): Mn/Fe/Co/Cu/ . . . etc, Mn/Ca/Rh/Pt/ . . . etc, and so forth.

Similar monofunctional bimetallic and polymetallic nanoalloy compositions can be assembled for groups B, C, and D, respectively, to specifically address deposits (B), corrosion (C), and combustion co-modifier/electrostatic precipitator (D). Electrostatic precipitators (ESP) are installed in the flue gas after treatment systems of atmospheric pressure combustion systems (stationary burners) used in power utility furnaces/boilers, industrial furnaces/boilers, and waste incineration units. The ESP is a series of charged electrode plates in the flow path of combustion exhaust that electrostatically traps the fine particulate onto the plates so that they are not exhausted into the environment. Metals in group D above are known to enhance and maintain the optimum performance of the ESP in this task.

Polyfunctional alloy compositions can be formed between two or more different metal atoms across the functional groups A, B, C and D as shown in the following non-limiting examples:

Bifunctional (e.g., $A_a/B_b$, $A_a/C_c$, $A_a/D_d$, $B_b/C_c$, $B_b/D_d$, and $C_cD_d$): Mn/Mg, Mn/Al, Mn/Cu, Mn/Mo, Mn/Ti, etc.

Trifunctional (e.g., $A_a/B_b/C_c$, $A_a/C_c/D_d$, or $B_b/C_c/D_d$): Mn/Al/Mg, Fe/Mg/Cu, Cu/Si/Mg, etc., Tetrafunctional ($A_a/B_b/C_c/D_d$): Mn/Mo/Mg/Na, Fe/Al/Mg/Li, etc.

Nanoalloys from combinations, such as $A_aB_b$, can also directly affect emissions. Optimization of combustion and minimization of deposits in the combustion system/exhaust after-treatment system can lead to lower emissions of environmental pollutants.

Similar combinations can be prepared, for example, for $A_a/C_c$, $A_a/D_d$, $B_b/C_c$, $B_b/D_d$, and $C_c/D_d$, respectively, to address: combustion/corrosion ($A_a/C_c$), combustion/combustion co-modifier and ESP ($A_a/D_d$), deposits/corrosion ($B_b/C_c$), deposits/combustion co-modifier and ESP ($B_b/D_d$), and corrosion/combustion co-modifier and ESP ($C_c/D_d$).

The most practical method for bulk preparation of the disclosed alloys is reduction of the aqueous salt mixtures of the respective chosen formulation, using any suitable reductant such as alcohols, primary or secondary amines, alkanolamines, urea, hydrogen, Na- and Li-borohydrides, etc, and an appropriate detergent/dispersant or polymer coater. The reaction conditions require a judicious balance between stoichiometry, temperature, pressure, pH, and dispersant. Other methods of activating a reaction mixture such as sonication, microwave irradiation, plasma, and optically modified electromagnetic radiation (i.e. UV, IR, lasers, etc) can also be used to prepare the disclosed nanoalloys. The dispersant can also be the reductant (i.e. alkanolamines where the alcohol functional group does the reduction while the amine group coordinates the reacting nanocluster and controls size through dispersion in the reaction media). The dispersant can also be any chelating molecule with a polar head and a non polar tail. Manipulation of reaction conditions will determine rate of reaction which will also determine the physical composition of the nanoalloy. For example, fast reaction rates will lead to low density and porous nanoalloys, and slow reaction rates to a denser and less porous product. Porous nanoalloys will find enhanced utility in atmosphere combustion systems, while denser nanoalloys will be better suited for pressurized combustion systems. A more specialized method for forming porous nanoalloys is the sol-gel method, such as that developed by the Lawrence Livermore National Laboratory (LLNL).

Another exemplary method that can be suited to bulk preparation of the disclosed nanoalloys is the mechanochemical method where liquid metal precursors are not necessary. Powders of the respective metal components are mixed and physically ground together under temperatures and pressures sufficient to form the alloy. The disadvantage with this method is that the resultant nanoalloy will be of a higher density hence of lower porosity. This reduced surface area will adversely affect gas phase combustion, combustion emissions removal (i.e., $SO_3$ and $NO_x$ from flue gases of utility boilers and incinerator furnaces), and deposit modification (slag in furnaces). However, such higher density nanoalloys will find utility in ceramics.

In an aspect, the disclosed alloys are made without doping, such as substitution doping or interstitial doping. U.S. Patent Application No. 2005/0066571 discloses several methods for doping cerium oxide.

The alloys herein can be formulated into additives that can be in any form, including but not limited to, crystalline (powder), or liquids (aqueous solutions, hydrocarbon solutions, or emulsions). The liquids can possess the property of being transformable into water/hydrocarbon emulsions using suitable solvents and emulsifier/surfactant combination.

In an aspect, the alloys can be coated or otherwise treated with suitable hydrocarbon molecules that render them fuel soluble. The alloy can be coated to prevent agglomeration. For this purpose, the alloy can be comminuted in an organic solvent in the presence of a coating agent which is an organic acid, anhydride or ester or a Lewis base. It has been found that, in this way which involves coating in situ, it is possible to significantly improve the coating of the alloy. Further, the resulting product can, in many instances, be used directly without any intermediate step. Thus in some coating procedures it is necessary to dry the coated alloy before dispersing it in a hydrocarbon solvent.

The coating agent can suitably be an organic acid, anhydride or ester or a Lewis base. The coating agent can be, for example, an organic carboxylic acid or an anhydride, typically one possessing at least about 8 carbon atoms, for example about 10 to about 25 carbon atoms, for example from about 12 to 18 carbon atoms, such as stearic acid. It will be appreciated that the carbon chain can be saturated or unsaturated, for example ethylenically unsaturated as in oleic acid. Similar comments apply to the anhydrides which can be used. An exemplary anhydride is dodecylsuccinic anhydride. Other organic acids, anhydrides and esters which can be used in the process of the present disclosure include those derived from phosphoric acid and sulphonic acid. The esters are typically aliphatic esters, for example alkyl esters where both the acid and ester parts have from about 4 to about 18 carbon atoms.

Other coating or capping agents which can be used include Lewis bases which possess an aliphatic chain of at least about 8 carbon atoms including mercapto compounds, phosphines, phosphine oxides and amines as well as long chain ethers, diols, esters and aldehydes. Polymeric materials including dendrimers can also be used provided that they possess a hydrophobic chain of at least about 8 carbon atoms and one or more Lewis base groups, as well as mixtures of two or more such acids and/or Lewis bases.

Typical polar Lewis bases include trialkylphosphine oxides $P(R^3)_3O$, for example trioctylphosphine oxide (TOPO), trialkylphosphines, $P(R^3)_3$, amines $N(R^3)_2$, thiocompounds $S(R)_2$ and carboxylic acids or esters $R^3COOR_4$ and mixtures thereof, wherein each $R^3$, which may be identical or different, is selected from $C_{1-24}$ alkyl groups, $C_{2-24}$ alkenyl groups, alkoxy groups of formula —$O(C_{1-24}alkyl)$, aryl groups and heterocyclic groups, with the proviso that at least one group $R^3$ in each molecule is other than hydrogen; and wherein $R^4$ is selected from hydrogen and $C_{1-24}$ alkyl groups, for example hydrogen and $C_{1-14}$ alkyl groups. Typical examples of $C_{1-24}$ and $C_{1-4}$ alkyl groups, $C_{2-24}$ alkenyl groups, aryl groups and heterocyclic groups are described below.

It is also possible to use as the polar Lewis base a polymer, including dendrimers, containing an electron rich group such as a polymer containing one or more of the moieties $P(R^3)_3O$, $P(R^3)_3$, $N(R^3)_2$, $S(R^3)_2$ or $R^3COOR_4$ wherein $R^3$ and $R^4$ are as defined above; or a mixture of Lewis bases such as a mixture of two or more of the compounds or polymers mentioned above.

The coating process can be carried out in an organic solvent. For example, the solvent is non-polar and is also, for example, non-hydrophilic. It can be an aliphatic or an aromatic solvent. Typical examples include toluene, xylene, petrol, diesel fuel as well as heavier fuel oils. Naturally, the organic solvent used should be selected so that it is compatible with the intended end use of the coated alloy. The presence of water should be avoided; the use of an anhydride as coating agent helps to eliminate any water present.

The coating process involves comminuting the alloy so as to prevent any agglomerates from forming. The technique employed should be chosen so that the alloys are adequately wetted by the coating agent and a degree of pressure or shear is desirable. Techniques which can be used for this purpose include high-speed stirring (e.g. at least 500 rpm) or tumbling, the use of a colloid mill, ultrasonics or ball milling. Typically, ball milling can be carried out in a pot where the larger the pot the larger the balls. By way of example, ceramic balls of 7 to 10 mm diameter are suitable when the milling takes place in a 1.25 liter pot. The time required will of course, be dependent on the nature of the alloy but, generally, at least 4 hours is required. Good results can generally be obtained after 24 hours so that the typical time is from about 12 to about 36 hours.

In an aspect, the composition comprising the disclosed alloy, such as a treated alloy, can be a fuel additive composition. The disclosed fuel additive composition can comprise other optional additives including, but not limited to, dispersants, detergents, pour point depressants, anti-swell agents, friction modifiers, antioxidants, corrosion inhibitor, rust inhibitor, foam inhibitor, anti-wear agent, demulsifier, and viscosity index improver. Any desired and effective amount of these optional additives can be used.

Also disclosed herein is a method of producing a fuel additive composition comprising treating the disclosed alloy with an organic compound; and solubilizing the treated alloy in a diluent. One of ordinary skill in the art would know the various diluents suitable for use in producing the fuel additive composition.

Also, disclosed herein is a fuel composition comprising a major amount of a fuel and a minor amount of the fuel additive composition comprising at least one of the disclosed alloys, such as a treated alloy, a nanoalloy, or a treated nanoalloy. The term "major amount" is understood to mean greater than or equal to 50% relative to the total amount of the fuel composition. Similarly, the term "minor amount" is understood to mean less than 50% relative to the total amount of the fuel composition.

By "fuel" herein is meant hydrocarbonaceous fuels such as, but not limited to, diesel fuel, jet fuel, alcohols, ethers, kerosene, low sulfur fuels, synthetic fuels, such as Fischer-Tropsch fuels, liquid petroleum gas, bunker oils, gas to liquid (GTL) fuels, coal to liquid (CTL) fuels, biomass to liquid (BTL) fuels, high asphaltene fuels, fuels derived from coal (natural, cleaned, and petcoke), genetically engineered biofuels and crops and extracts therefrom, natural gas, propane, butane, unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Oxygenates suitable for use in the fuels of the present disclosure include methanol, ethanol, isopropanol, t-butanol, mixed alcohols, methyl tertiary butyl ether, tertiary amyl methyl ether, ethyl tertiary butyl ether and mixed ethers. Oxygenates, when used, will normally be present in the reformulated gasoline fuel in an amount below about 25% by volume, and for example in an amount that provides an oxygen content in the overall fuel in the range of about 0.5 to about 5 percent by volume. "Hydrocarbonaceous fuel" or "fuel" herein shall also mean waste or used engine or motor oils which may or may not contain molybdenum, gasoline, bunker fuel, coal (dust or slurry), crude oil, refinery "bottoms" and by-products, crude oil extracts, hazardous wastes, yard trimmings and waste, wood chips and saw dust, agricultural waste, fodder, silage, plastics and other organic waste and/or by-products, and mixtures thereof, and emulsions, suspensions, and dispersions thereof in water, alcohol, or other carrier fluids. By "diesel fuel" herein is meant one or more fuels selected from the group consisting of diesel fuel, biodiesel, biodiesel-derived fuel, synthetic diesel and mixtures thereof. In an aspect, the hydrocarbonaceous fuel is substantially sulfur-free, by which is meant a sulfur content not to exceed on average about 30 ppm of the fuel.

In an aspect, there is disclosed a method of modifying the combustion of a fuel in a combustion system, the method comprising providing to the combustion system a combustion modifier. The combustion modifier can comprise an alloy represented by the following generic formula $(A_a)_n(B_b)_n(C_c)_n(D_d)_n(\ldots)_n$; wherein each capital letter and $(\ldots)$ is a metal; wherein A is a combustion modifier; B is a deposit modifier; C is a corrosion inhibitor; and D is a combustion co-modifier/electrostatic precipitator (ESP) enhancer; wherein each subscript letter represents compositional stoichiometry; wherein n is greater than or equal to zero; and wherein the alloy comprises at least two different metals, one of which is A; and with the proviso that if the metal is cerium, then its compositional stoichiometry is less than about 0.7. The term "modifying" as used herein is understood to mean either improving or reducing the combustion of the fuel as compared to a fuel that does not comprise the disclosed alloy.

Improvement of combustion can be a first step in modifying deposit levels, emissions, and corrosion.

Moreover, there is disclosed a method of modifying the deposit levels from the combustion of a fuel in a combustion system, the method comprising providing to the combustion system a deposit modifier. The deposit modifier can comprise an alloy represented by the following generic formula $(A_a)_n(B_b)_n(C_c)_n(D_d)_n(\ldots)_n$; wherein each capital letter and $(\ldots)$ is a metal; wherein A is a combustion modifier; B is a deposit modifier; C is a corrosion inhibitor; and D is a combustion co-modifier/electrostatic precipitator (ESP) enhancer; wherein each subscript letter represents compositional stoichiometry; wherein n is greater than or equal to zero; and wherein the alloy comprises at least two different metals, one of which is B; and with the proviso that if the metal is cerium, then its compositional stoichiometry is less than about 0.7. The term "modifying" as used herein is understood to mean either improving or reducing the deposit levels of the fuel as compared to a fuel that does not comprise the disclosed alloy.

In an aspect, there is disclosed a method of modifying the corrosion of combustion system surfaces from the combustion by-products resulting from combustion of a fuel in a combustion system, the method comprising providing to the combustion system a corrosion modifier. The corrosion modifier can comprise an alloy represented by the following generic formula $(A_a)_n(B_b)_n(C_c)_n(D_d)_n(\ldots)_n$; wherein each capital letter and $(\ldots)$ is a metal; wherein A is a combustion modifier; B is a deposit modifier; C is a corrosion inhibitor; and D is a combustion co-modifier/electrostatic precipitator (ESP) enhancer; wherein each subscript letter represents compositional stoichiometry; wherein n is greater than or equal to zero; and wherein the alloy comprises at least two different metals, one of which is C; and with the proviso that if the metal is cerium, then its compositional stoichiometry is less than about 0.7. The term "modifying" as used herein is understood to mean either improving or reducing the corrosion of the combustion system surfaces from the combustion by-products resulting from combustion of the fuel as compared to a fuel that does not comprise the disclosed alloy.

In another aspect, there is disclosed a method of modifying the emissions from the combustion of a fuel in a combustion system, the method comprising providing to the combustion system the emission modifier. The emissions modifier can comprise an alloy represented by the following generic formula $(A_a)_n(B_b)_n(C_c)_n(D_d)_n(\ldots)_n$; wherein each capital letter and $(\ldots)$ is a metal; wherein A is a combustion modifier; B is a deposit modifier; C is a corrosion inhibitor; and D is a combustion co-modifier/electrostatic precipitator (ESP) enhancer; wherein each subscript letter represents compositional stoichiometry; wherein n is greater than or equal to zero; and wherein the alloy comprises at least two different metals, one of which is selected from the group consisting of A, B and D; and with the proviso that if the metal is cerium, then its compositional stoichiometry is less than about 0.7. The term "modifying" as used herein is understood to mean either improving or reducing the emissions of the combustion system resulting from combustion of the fuel as compared to a fuel that does not comprise the disclosed alloy.

The fuel additive composition comprising the disclosed nanoalloy can be delivered either upstream of the combustion system through the fuel, the combustion air, and/or other fluids such as lubricants that find their way into the combustion charge; and/or directly into the combustion charge; and/or downstream of combustion to further modify emissions, emission control systems, and deleterious deposits.

For liquid fuels, the additives containing the nanoalloy can be blended in at any point between the last fuel composition transformation stage and the burner. For solid fuels the additive containing the nanoalloy can be added to the raw fuel in a form that will wet and penetrate into it, and at the same time not increase the vapor pressure of the fuel during and after grinding to the final form for injection into the combustion system. For coals, an additional requirement is that the additive be of a significantly low vapor pressure that most of it remains in the char after devolatilization of the coal particles in the furnace.

By "combustion system" and "apparatus" herein is meant, for example and not by limitation herein, any diesel-electric hybrid vehicle, a gasoline-electric hybrid vehicle, a two-stroke engine, any and all burners or combustion units, including for example and without limitation herein, stationary burners (home heating, industrial, boilers, furnaces), waste incinerators, diesel fuel burners, diesel fuel engines (unit injected and common rail), jet engines, HCCI engines automotive diesel engines, gasoline fuel burners, gasoline fuel engines (PFI and DIG), power plant generators, and the like. The hydrocarbonaceous fuel combustion systems that may benefit from the present disclosure include all combustion units, systems, devices, and/or engines that burn fuels. By "combustion system" herein is also meant any and all internal and external combustion devices, machines, engines, turbine engines, jet engines, boilers, incinerators, evaporative burners, plasma burner systems, plasma arc, stationary burners, and the like which can combust or in which can be combusted a hydrocarbonaceous fuel.

The disclosed fuel compositions can be combusted in any combustion system, for example, an engine, such as a spark ignition engine or compression ignition engine, for example, advanced spark ignition and compression ignition engines with and without catalyzed exhaust after treatment systems with on-board diagnostic ("OBD") monitoring. To improve performance, fuel economy and emissions, advanced spark ignition engines may be equipped with the following: direct injection gasoline (DIG), variable valve timing (VVT), external exhaust gas recirculation (EGR), internal EGR, turbocharging, variably geometry turbocharging, supercharging, turbocharging/supercharging, multi-hole injectors, cylinder deactivation, and high compression ratio. The DIG engines may have any of the above including spray-, wall-, and spray/wall-guided in-cylinder fuel/air charge aerodynamics. More advanced DIG engines in the pipeline will be of a high compression ratio turbocharged and/or supercharged and with piezo-injectors capable of precise multi-pulsing of the fuel into the cylinder during an injection event. Exhaust after treatment improvements will include a regeneratable $NO_x$ trap with appropriate operation electronics and/or a $NO_x$ catalyst. The advanced DIG engines described above will be use in gasoline-electric hybrid platforms.

For compression ignition engines, there will be advanced emissions after treatment such as oxidation catalyst, particulate trap (PT), catalyzed PT, $NO_x$ trap, on-board $NO_x$ additive (i.e. urea) dosing into the exhaust to remove $NO_x$, and plasma reactors to remove $NO_x$. On the fuel delivery side common rail with piezo-activated injectors with injection rate-shaping software can be used. Ultra-high pressure fuel injection (from 1800 Bar all the way to 2,500 Bar), EGR, variable geometry turbocharging, gasoline homogeneous charge compression ignition (HCCI) and diesel HCCI. Gasoline- and diesel-HCCI in electric hybrid vehicle platforms can also be used.

The term "after treatment system" is used to mean any system, device, method, or combination thereof that acts on the exhaust stream or emissions resulting from the combustion of a diesel fuel. "After treatment systems" include all types of diesel particulate filters—catalyzed and uncatalyzed, lean $NO_x$ traps and catalysts, select catalyst reduction systems, $SO_x$ traps, diesel oxidation catalysts, mufflers, $NO_x$ sensors, oxygen sensors, temperature sensors, backpressure sensors, soot or particulate sensors, state of the exhaust monitors and sensors, and any other types of related systems and methods.

The disclosed fuel additive composition can also be combusted in other systems, such as those of atmospheric combustion used in utility and industrial burners, boilers, furnaces, and incinerators. These systems can burn from natural gas to liquid fuels (#5 fuel oil and heavier), to solid fuels (coals, wood chips, burnable solid wastes, etc).

Also, disclosed herein is the use in a combustion system of a nanoalloy fuel additive wherein the combustion system is selected from the group consisting of any diesel-electric hybrid vehicle, a gasoline-electric hybrid vehicle, a two-stroke engine, stationary burners, waste incinerators, diesel fuel burners, diesel fuel engines, jet engines, HCCI engines automotive diesel engines, gasoline fuel burners, gasoline fuel engines, and power plant generators.

Use in an emission control system of a nanoalloy fuel additive, wherein the emission control system is selected from the group consisting of an oxidation catalyst, particulate trap, catalyzed PT, $NO_x$, trap, on-board $NO_x$ additive dosing into the exhaust to remove $NO_x$, and plasma reactors to remove $NO_x$.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as formation of the organometallic compound) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations or immediately thereafter is thus wholly immaterial for an accurate understanding and appreciation of this disclosure and the claims thereof.

The following examples further illustrate aspects of the present disclosure but do not limit the present disclosure.

EXAMPLES

Several nanoalloys were prepared using known techniques. The nanoalloys had the following compositions:

$Ce_{66}Al_8O_{25}$ $Ce_{44}Fe_{30}O_{26}$ $Ce_{64}Cu_{22}O_{14}$ $Cu_{95}Fe_5$ $Cu_{15}Ce_{85}$ $Cu_{99}Ce_1$ $Cu_{0.75}Mg_{0.25}$ $Cu_{0.75}Mg_{0.25}$ $Cu_{0.85}Mn_{0.15}$ $Fe_{0.80}Ce_{0.20}$ $Fe_{0.84}Al_{0.10}Ce_{0.06}$

Figure 2:
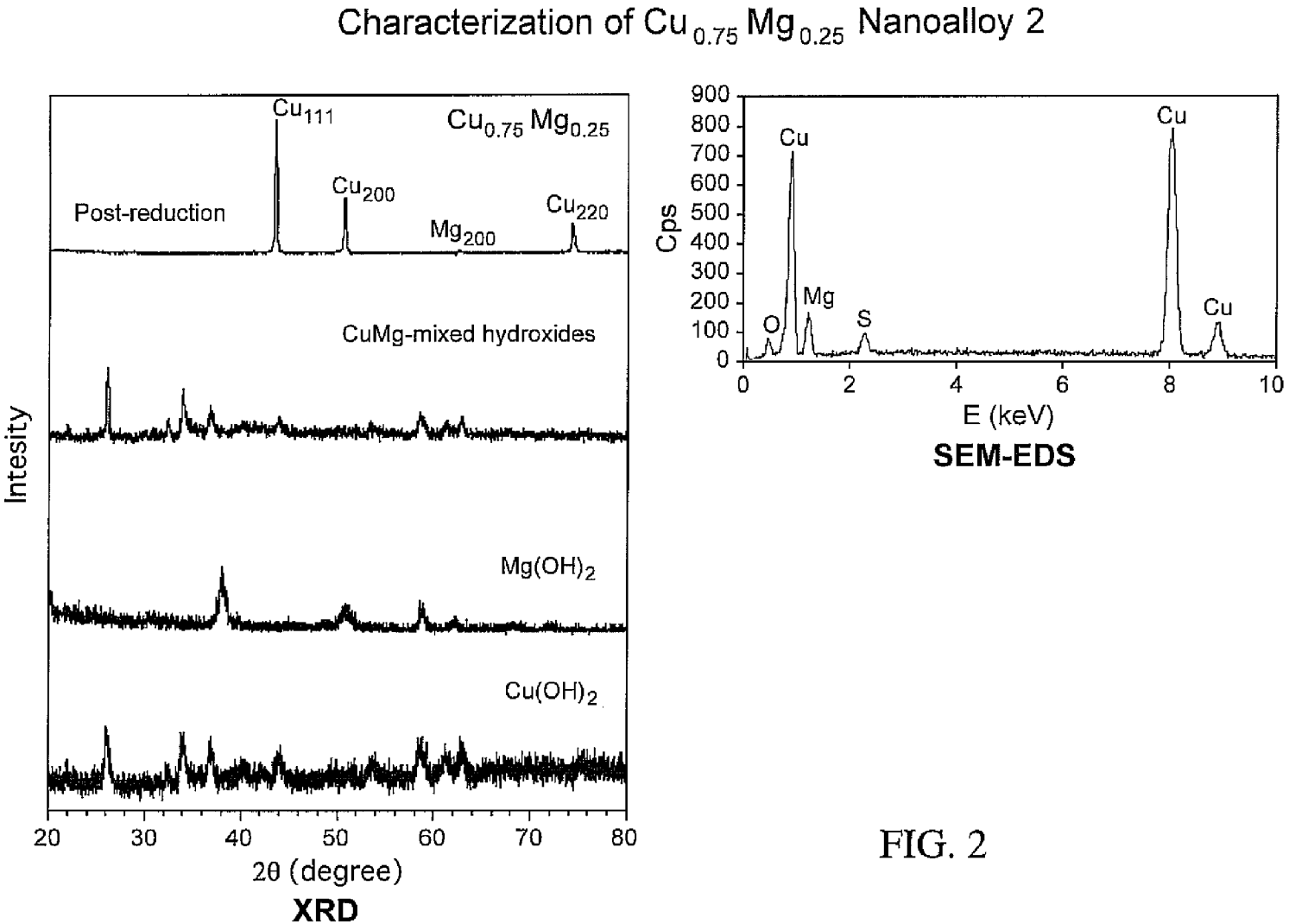
Figure 3:
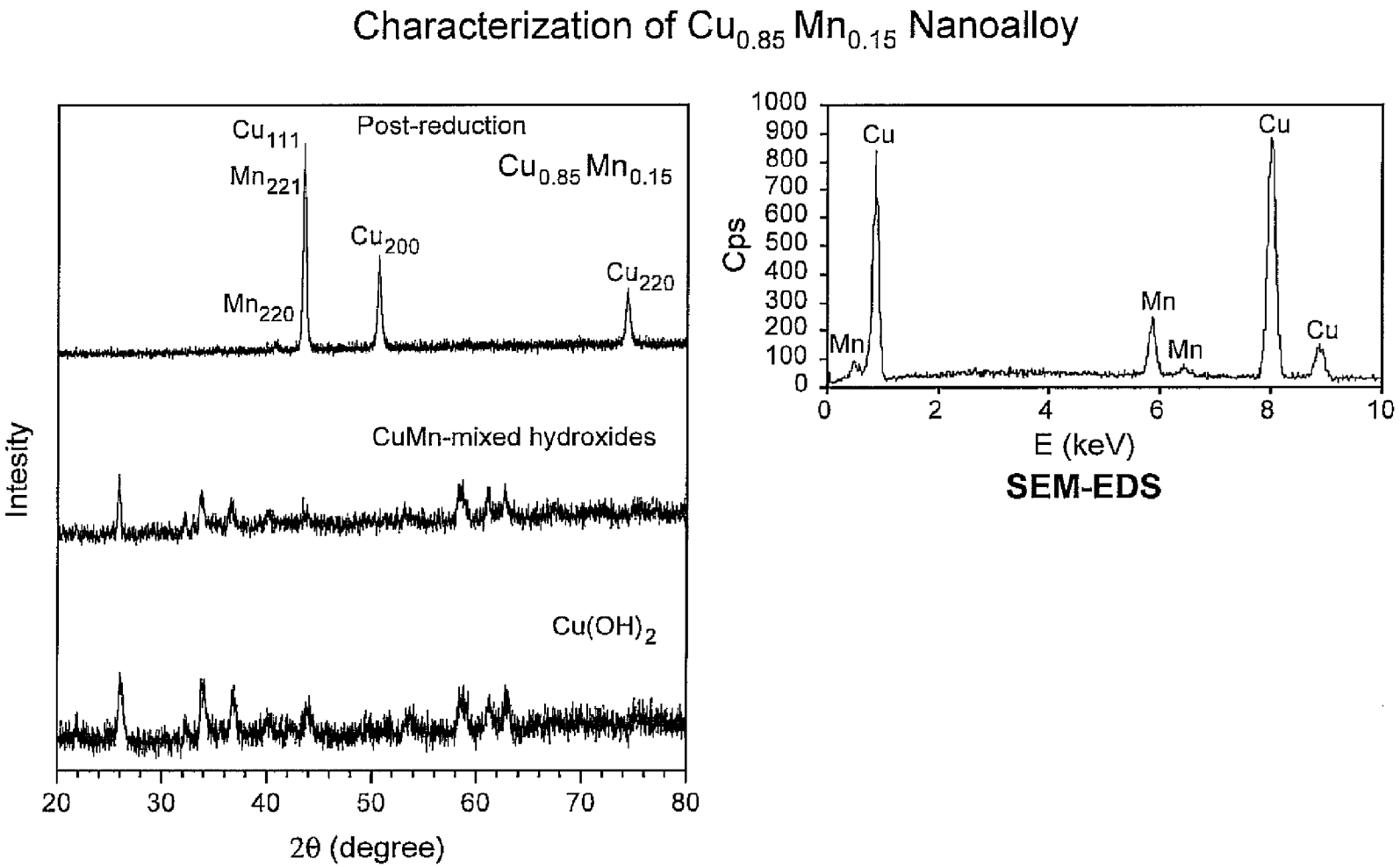
Figure 4:
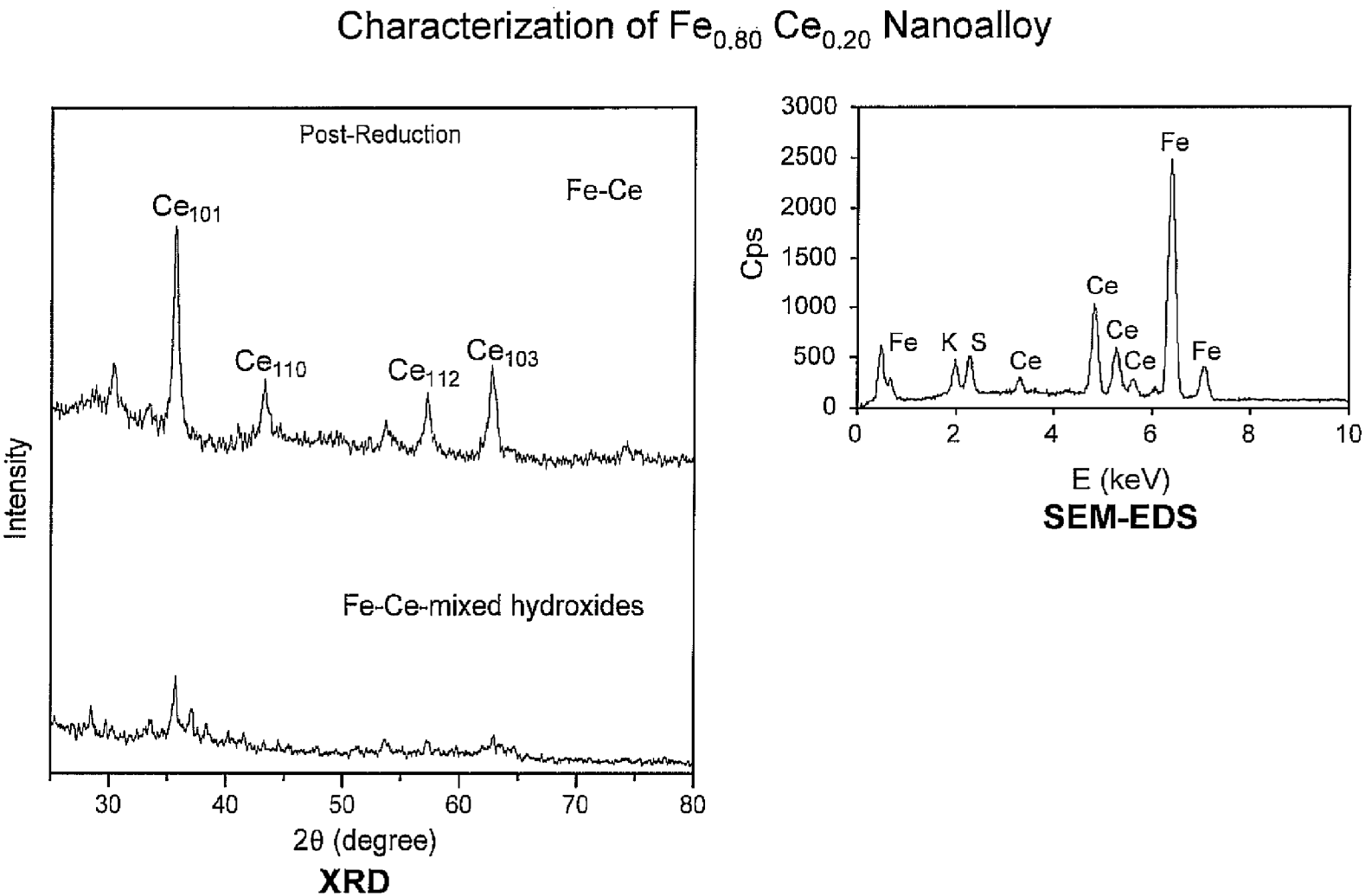
Figure 5:
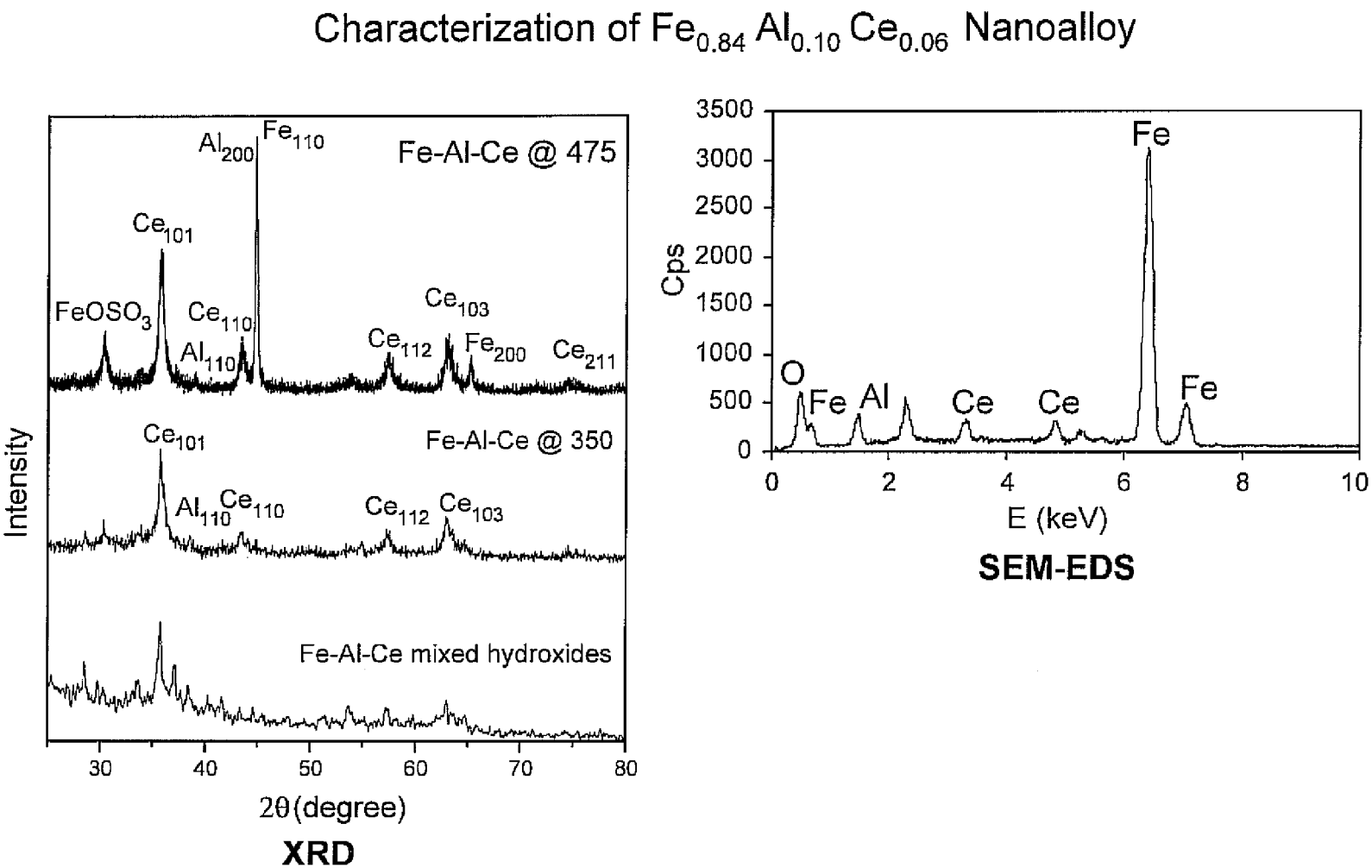
Figure 6:
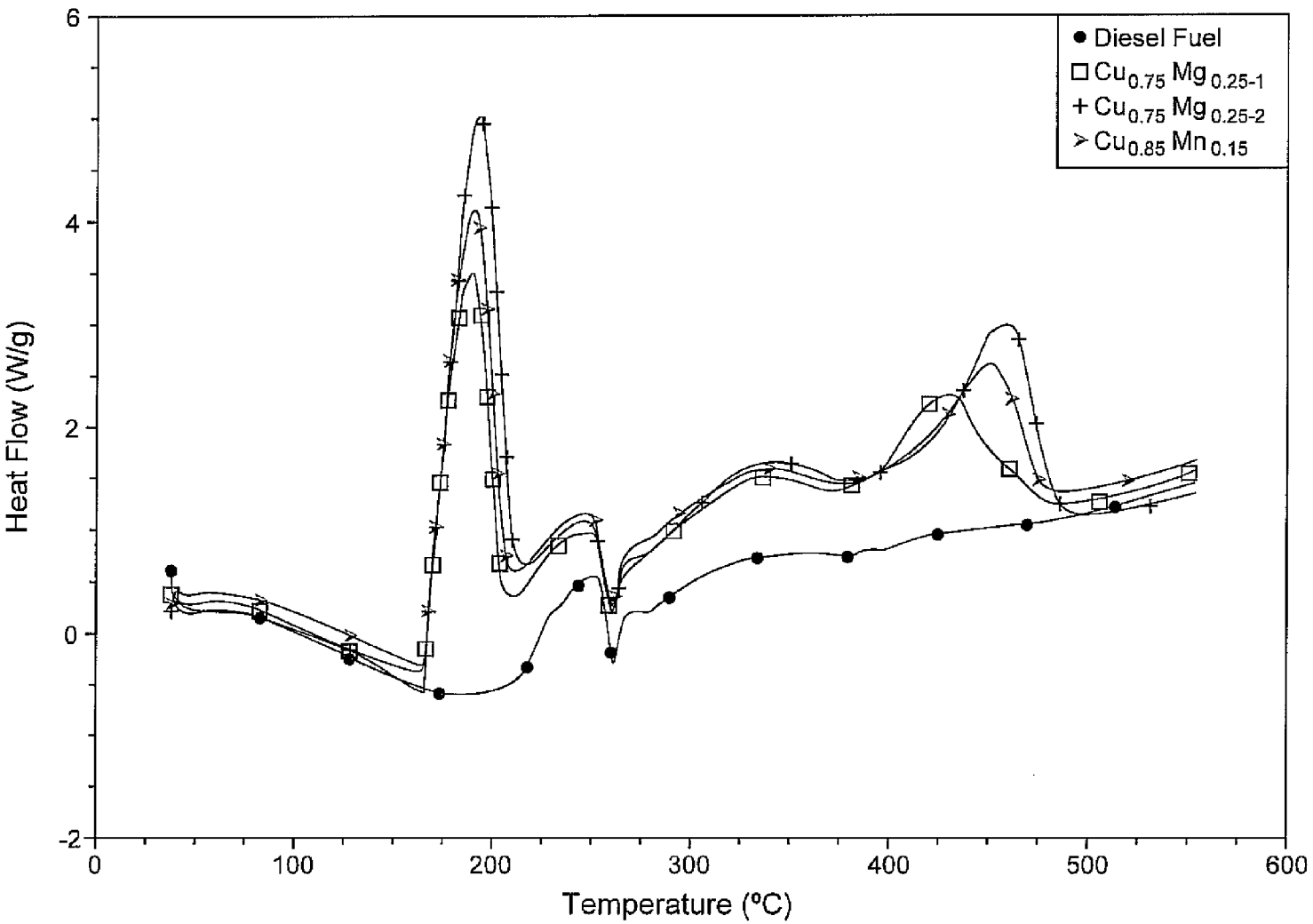
FIGS. 6-9 illustrate the PDSC results of various nanoalloys of the present disclosure.
Figure 7:
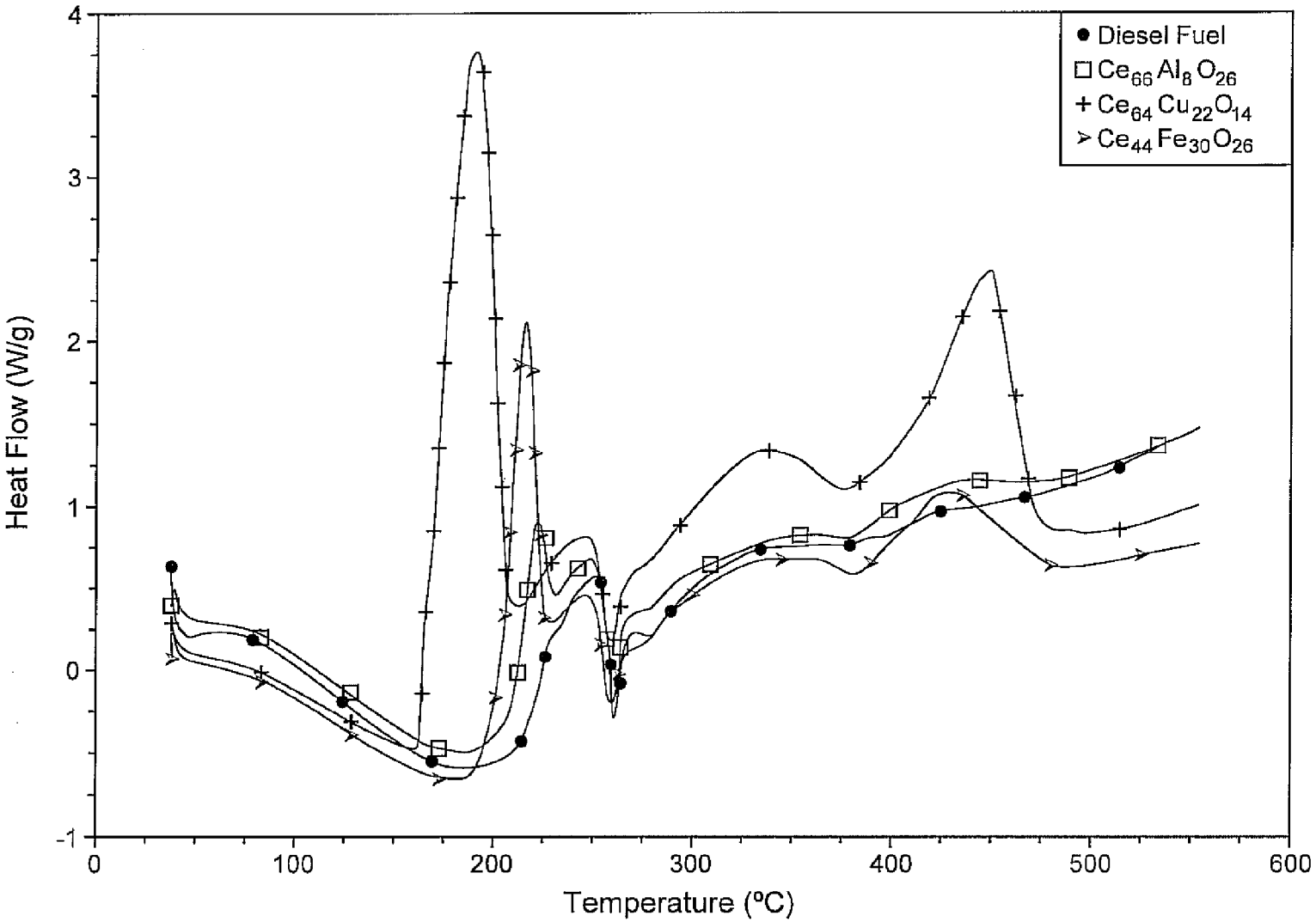
Figure 8:
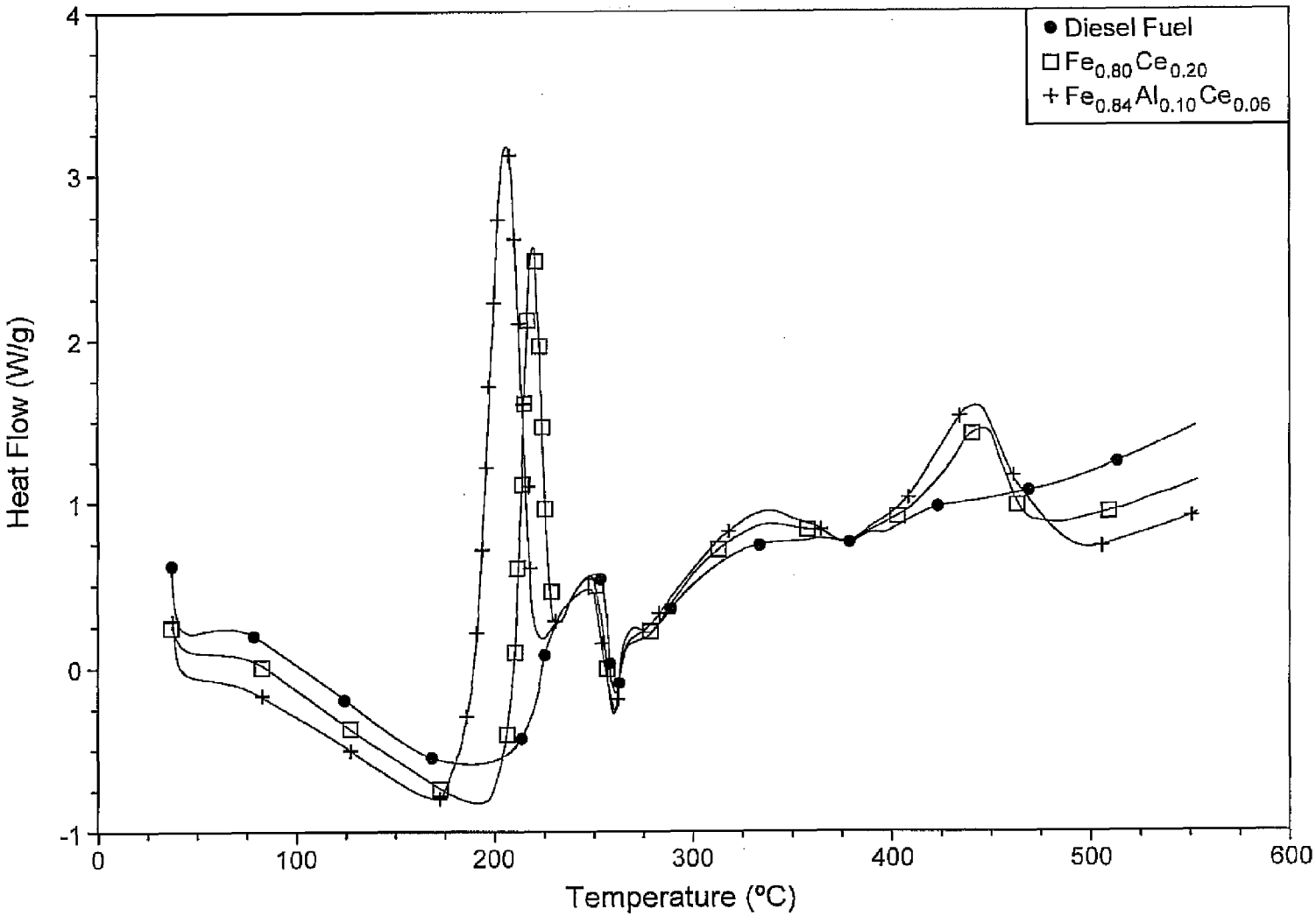
Figure 9:
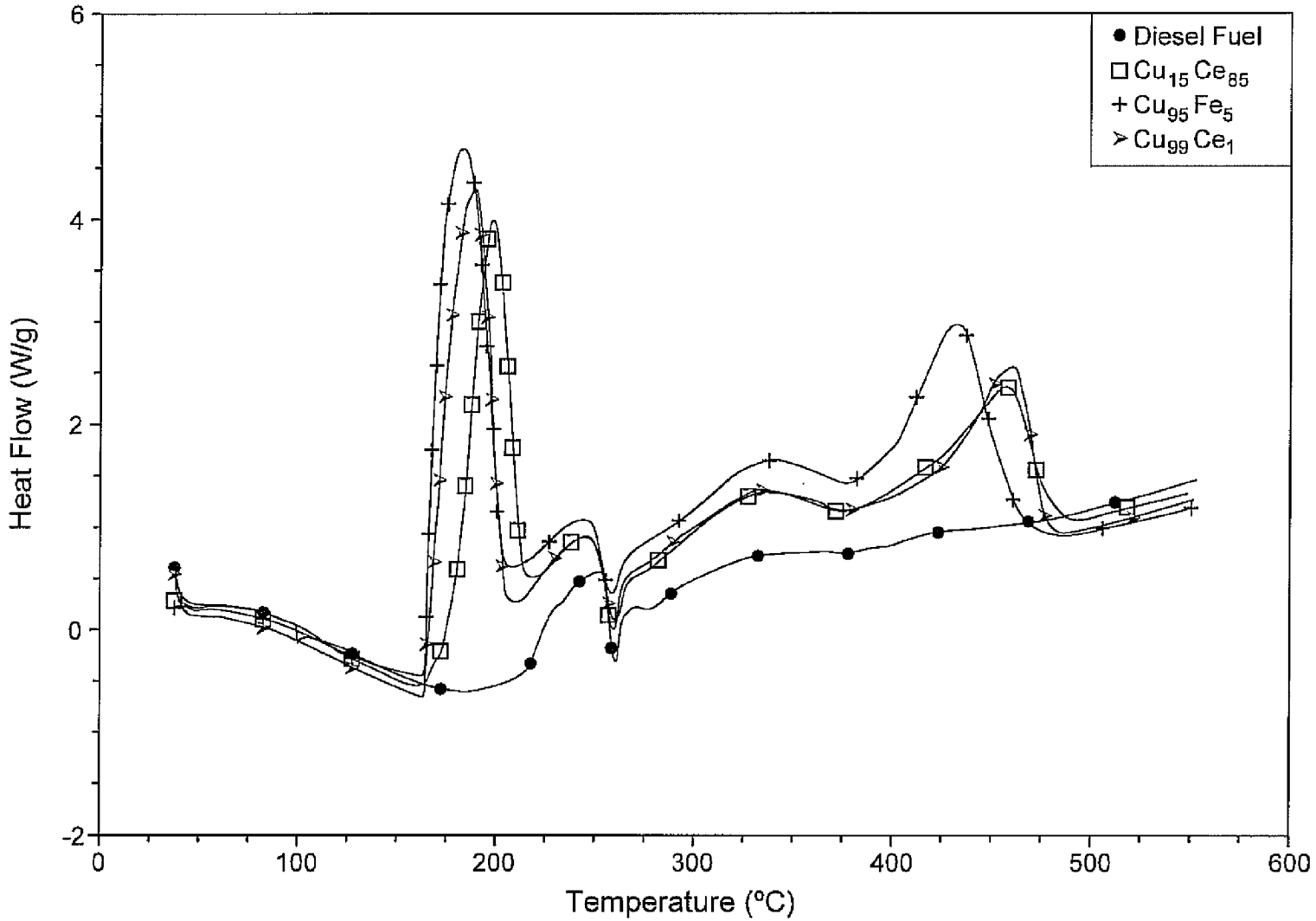

These nanoalloys were confirmed by XRD and SEM-EDS. For example, FIGS. 1 and 2 confirm the nanoalloy of formula $Cu_{0.75}Mg_{0.25}$. Moreover, FIG. 3 confirms the nanoalloy of formula $Cu_{0.85}Mn_{0.15}$. FIG. 4 confirms the nanoalloy of formula $Fe_{0.80}Ce_{0.20}$. Further, FIG. 5 confirms the nanoalloy of formula $Fe_{0.84}Al_{0.10}Ce_{0.06}$. The average particle sizes of these nanoalloys ranged from about 5 to about 25 nanometers landing them comfortably in the nanosize range which has an upper limit of 100 nm. TEM, SEM-EDS and XRD confirmed them to be either homogeneous nanoalloys, or contact nanolloys, where all metal components are represented in the XRD unit cell. This is not the case with mixtures or "doped" mixed metal compositions.

Nanoalloy Additive Fuel Compositions

To ensure their combustion capability, these new nanoallys were dissolved/dispersed in fuel and characterized by pressure differential scanning calorimetry (PDSC) and found to be quite active combustion catalyst. Each respective nanoalloy powder was dispersed in number 2 diesel using a polyisobutylene-substituted succinimide dispersant. A milligram sample of the fuel was transferred to a pressure differential scanning calorimeter (PDSC), pressurized with 100 psi air, and heated at a rate of 10° C. per minute to 550° C. The results are shown in FIGS. 6-9 for the eleven nanoalloys disclosed above. As can be seen in the plots, the nanoalloys were effective as fuel combustion modifiers by lowering the temperature at which the exotherm was initiated. Relative to the base fuel, all the modifiers facilitated three significant exotherms that peak at about 175, 325 and 450° C. In addition, the exotherms were shifted towards lower temperatures relative to the exotherm observed from combusting the base fuel alone. This indicated that these nanoalloy fuel additives initiated thermal energy releasing reactions (combustion) at lower temperatures. Also the kinetics of oxidation at these lower temperatures were greatly enhanced by the additives relative to the base fuel, as can be seen in the peaks of the observed exotherms.

At numerous places throughout this specification, reference has been made to a number of U.S. patents, published foreign patent applications and published technical papers. All such cited documents are expressly incorporated in full into this disclosure as if fully set forth herein.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

What is claimed is:

1. A method of producing a fuel composition comprising: treating an alloy with an organic compound; solubilizing the treated alloy in a diluents; and combining the treated alloy with a motor gasoline fuel; wherein the alloy comprises the following generic formula $(A_a)_n(B_b)_n(C_c)_n(D_d)_n$;

wherein each capital letter is a metal except for boron, germanium, arsenic, antimony, tellurium, and polonium;

wherein A is a combustion modifier selected from the group consisting of Mn, Fe, Co, Cu, Ca, Rh, Pd, Pt, Ru, Ir, Ag, Au, and Ce;

B is a deposit modifier selected from the group consisting of Mg, Al, Si, Sc, Ti, Zn, Sr, Y, Zr, Mo, In, Sn, Ba, La, Hf, Ta, W, Re, Yb, Lu, Cu and Ce;

C is a corrosion inhibitor selected from the group consisting of Mg, Ca, Sr, Ba, Mn, Cu, Zn, and Cr; and D is a combustion co-modifier/electrostatic precipitator enhancer selected from the group consisting of Li, Na, K, Rb, Cs, and Mn;

wherein each subscript letter except n represents compositional stoichiometry;

wherein n is greater than or equal to zero and the sum of the n's is greater than or equal to 2; and wherein the alloy of the fuel additive composition comprises at least two different metals; and with the proviso that if the metal is cerium, then its compositional stoichiometry is less than about 0.7.

2. A motor gasoline fuel composition comprising:

a major amount of a motor gasoline fuel; and a minor amount of a fuel additive composition comprising: an alloy comprising the following generic formula $(A_a)_n(B_b)_n(C_c)_n(D_d)_n$;

wherein each capital letter is a metal except for boron, germanium, arsenic, antimony, tellurium, and polonium;

wherein A is a combustion modifier selected from the group consisting of Mn, Fe, Co, Cu, Ca, Rh, Pd, Pt, Ru, Ir, Aq, Au, and Ce;

B is a deposit modifier selected from the group consisting of Mg, Al, Si, Sc, Ti, Zn, Sr, Y, Zr, Mo, In, Sn, Ba, La, Hf, Ta, W, Re, Yb, Lu, Cu and Ce;

C is a corrosion inhibitor selected from the group consisting of Mg, Ca, Sr, Ba, Mn, Cu, Zn, and Cr; and D is a combustion co-modifier/electrostatic precipitator enhancer selected from the group consisting of Li, Na, K, Rb, Cs, and Mn;

wherein each subscript letter except n represents compositional stoichiometry;

wherein n is greater than or equal to zero and the sum of the n's is greater than or equal to 2; and wherein the alloy of the fuel additive composition comprises at least two different metals; and with the proviso that if the metal is cerium, then its compositional stoichiometry is less than about 0.7.

3. The composition of claim 2, wherein the metal is selected from the group consisting of transition metals, and metal ions.

4. The composition of claim 2, further comprising wherein A, B and/or D is an emissions modifier.

5. The composition of claim 2, wherein the alloy is a nanoalloy comprising an average particle size of from about 1 to about 100 nanometers.

6. The composition of claim 2, wherein the alloy is a nanoalloy comprising an average particle size of from about 5 to about 75 nanometers.

7. The composition of claim 2, wherein the alloy is bimetallic.

8. The composition of claim 2, wherein the alloy is trimetallic.

9. The composition of claim 2, wherein the alloy is tetrametallic.

10. The composition of claim 2, wherein the alloy is polymetallic.

11. The composition of claim 2, wherein the alloy is monofunctional.

12. The composition of claim 2, wherein the alloy is bifunctional.

13. The composition of claim 2, wherein the alloy is trifunctional.

14. The composition of claim 2, wherein the alloy is tetrafunctional.

15. The composition of claim 2, wherein the alloy is polyfunctional.

16. The composition of claim 2, wherein the alloy is selected from the group consisting of bimetallic, trimetallic, tetrametallic, and polymetallic; and wherein the alloy is selected from the group consisting of monofunctional, bifunctional, trifunctional, tetrafunctional, and polyfunctional.

17. The composition of claim 2, wherein the alloy is treated with an organic compound.

18. The composition of claim 17, wherein the organic compound is selected from the group consisting of an organic carboxylic acid, organic anhydride, organic ester, and a Lewis base.

19. The composition of claim 18, wherein the organic carboxylic acid and organic anhydride comprise at least about 8 carbon atoms.

20. The composition of claim 18, wherein the organic ester is an aliphatic ester.

21. The composition of claim 18, wherein the Lewis base comprises an aliphatic chain comprising at least 8 carbon atoms.

22. The motor gasoline fuel composition of claim 2, further comprising optional additives chosen from dispersants, detergents, pour point depressants, anti-swell agents, friction modifiers, antioxidants, corrosion inhibitor, rust inhibitor, foam inhibitor, anti-wear agent, demulsifier, and viscosity index improver.

23. The fuel composition of claim 2, wherein the fuel is an unleaded motor gasoline.

* * * * *